US008314755B2

(12) United States Patent
Ono

(10) Patent No.: US 8,314,755 B2
(45) Date of Patent: Nov. 20, 2012

(54) IMAGE DISPLAY DEVICE

(75) Inventor: Shinya Ono, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/432,386

(22) Filed: Mar. 28, 2012

(65) Prior Publication Data

US 2012/0194501 A1 Aug. 2, 2012

Related U.S. Application Data

(63) Continuation of application No. 12/443,054, filed as application No. PCT/JP2008/001455 on Jun. 9, 2008, now Pat. No. 8,169,385.

(30) Foreign Application Priority Data

Jun. 15, 2007 (JP) ..... 2007-158254

(51) Int. Cl.
*G09G 3/30* (2006.01)

(52) U.S. Cl. ..... 345/76; 345/212

(58) Field of Classification Search ..... 345/76–84
See application file for complete search history.

(56) References Cited

U.S. PATENT DOCUMENTS

2005/0237273 A1 10/2005 Ozawa et al.

FOREIGN PATENT DOCUMENTS

| | | | |
|---|---|---|---|
| JP | 2002-514320 | A | 5/2002 |
| JP | 2003-208127 | A | 7/2003 |
| JP | 2004-280059 | A | 10/2004 |
| JP | 2006-209074 | A | 8/2006 |
| JP | 2006-309104 | A | 11/2006 |
| JP | 2007-133282 | A | 5/2007 |
| WO | WO2006/090560 | A1 | 8/2006 |

OTHER PUBLICATIONS

International Search Report for PCT/JP2008/001455 dated Jul. 15, 2008.

*Primary Examiner* — Alexander Eisen
*Assistant Examiner* — Robin Mishler
(74) *Attorney, Agent, or Firm* — RatnerPrestia

(57) ABSTRACT

In an image display device, a transistor formed in each pixel circuit is an N-channel transistor. Each pixel circuit further comprises an enable switch disposed in a current path supplying electric current to a light-emitting element and a supplementary capacitor for controlling changes in voltage of a terminal of a holding capacitor at one end opposite another terminal connected with writing switch. The light-emitting element is connected between the source of a driver transistor for supplying a current to the light-emitting element and a low-voltage side power line, an enable switch is connected between the drain of the driver transistor and a high-voltage side power line, and supplementary capacitor is connected between the drain of driver transistor and a predetermined power line.

3 Claims, 6 Drawing Sheets

IMAGE DISPLAY DEVICE

This application is a continuation of U.S. patent application Ser. No. 12/443,054, filed on Mar. 26, 2009, which is incorporated herein by reference.

TECHNICAL FIELD

The present invention relates to an active-matrix type image display device using current-driven type light-emitting elements.

BACKGROUND ART

Organic electroluminescence ("EL") display devices of a type comprising a matrix of a large number of self-luminous organic EL elements hold great promise as the next generation of image display devices since they require no backlighting nor do they restrict viewing angles.

The organic EL elements are light-emitting elements of a current-driven type, of which brightness can be controlled by an amount of electric current flowed through them. There are simple matrix type and active matrix type as the methods of driving the organic EL elements. The former has a drawback that it is difficult to produce a large-scale and high-definition display although it only needs simple pixel circuits. It is for this reason that the efforts are being made actively in recent years for development of organic EL display devices of the active matrix type, which is composed of a matrix of pixel circuits having organic EL elements, each provided with a driver transistor for driving the current-driven type light-emitting element.

The driver transistor and the peripheral circuit are formed generally of thin film transistors. There are thin film transistors of a type made of polysilicon and another type made of amorphous silicon. The amorphous silicon thin-film transistors are suitable for large-scale organic EL display devices since they feature a high uniformity in mobility, easy to fit for upsizing, and inexpensive, although they have some weaknesses such as poor mobility and large changes in the threshold voltage with time. There have been some studies conducted for measures to overcome the weakness, or the changes in the threshold voltage with time, of the amorphous silicon thin-film transistors by improvements of the pixel circuits. Patent document 1, for instance, discloses an organic EL display device having pixel circuits capable of displaying stable images by keeping an amount of the currents supplied to the light-emitting elements free from influence of the threshold voltage of thin film transistors even when the threshold voltage changes.

In addition, patent document 2 discloses a compensation circuit as a more advanced compensating function for compensating degradation of organic EL elements in order to achieve further extension of useful life of display devices.

However, the pixel circuit disclosed in the patent document 1 is comprised of P-channel transistors. On the other hand, there are only N-channel transistors that are now available as amorphous-silicon thin-film transistors for practical use in large-scale image display devices, and it is therefore necessary to compose the image circuits only with N-channel transistors. In addition, it is also preferable that the pixel circuits have a structure allowing connections of anodes of organic EL elements to sources of driver transistors and cathodes of the organic EL elements to a common electrode so as to ease the manufacturing of organic EL display devices. Furthermore, there exists the need for pixel compensation circuits operable in a source-grounded structure in order to reduce unevenness in luminous brightness, which is liable to occur due to voltage drops resulting from electrical resistances of power lines and currents flowing therethrough when the organic EL elements are lit.

The circuit for compensating degradation of the organic EL elements as disclosed in the patent document 2 has a source-grounded structure designed to use P-channel transistors, and it is therefore impossible to achieve the circuit by using amorphous silicon transistors, which offer no choice but only of the N-channel type.

[Patent Document 1] Japanese Translation of PCT Publication, No. 2002-514320

[Patent Document 2] Japanese Patent Unexamined Publication, No. 2006-309104

SUMMARY OF THE INVENTION

An image display device of the present invention comprises a plurality of pixel circuits arranged in a matrix form, each of the pixel circuits having a current-driven type light-emitting element, a driver transistor for supplying an electric current to the current-driven type light-emitting element, a holding capacitor for holding a voltage that determines an amount of the electric current supplied from the driver transistor and a writing switch for writing a voltage corresponding to an image signal into the holding capacitor. The transistor formed in each of the pixel circuits is an N-channel transistor. Each of the pixel circuits further comprises an enable switch disposed in a current path supplying the electric current to the current-driven type light-emitting element and a supplementary capacitor for controlling changes in voltage of a terminal of the holding capacitor at one end opposite another terminal connected with the writing switch. The current-driven type light-emitting element is connected between a source of the driver transistor and a low-voltage side power line. The enable switch is connected between a drain of the driver transistor and a high-voltage side power line. The supplementary capacitor is connected between the drain of the driver transistor and a predetermined power line. It becomes possible according to the above structure to provide the image display device comprising the pixel circuits having the current-driven type light-emitting elements connected with the sources of the driver transistors and capable of compensating degradation in characteristic of the current-driven type light-emitting elements, yet the pixel circuits can be formed of only N-channel transistors.

It is desirable that each of the pixel circuits also comprises a separation switch connected between the source of the driver transistor and one terminal of the holding capacitor, and a gate-drain connecting switch connected between a gate and the drain of the driver transistor.

REFERENCE MARKS IN THE DRAWINGS

Figure 1:
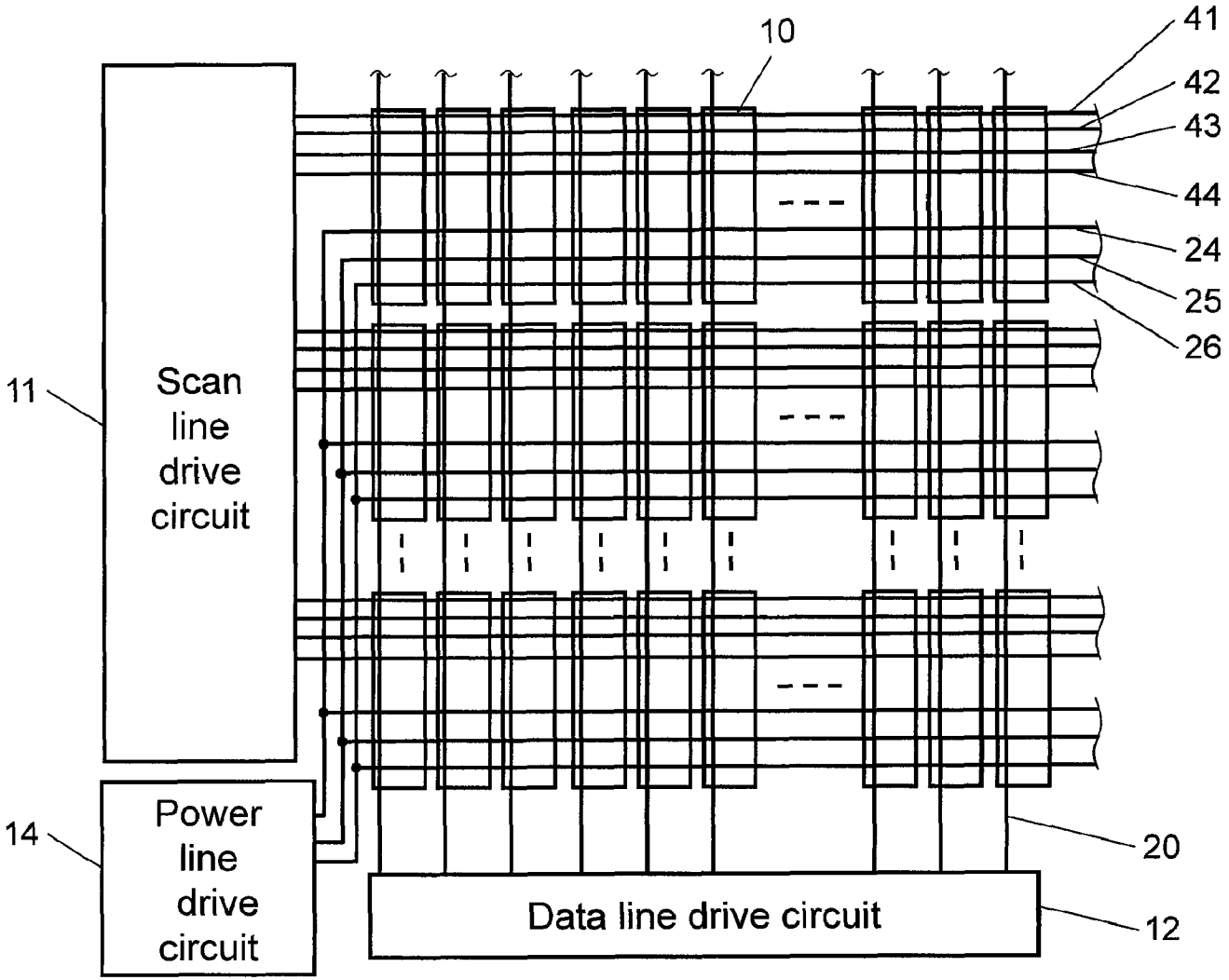
FIG. 1 is a schematic diagram showing a structure of an organic EL display device according to an exemplary embodiment of the present invention.

10 Pixel circuit
11 Scan line drive circuit
12 Data line drive circuit
14 Power line drive circuit
20 Data line
24 High-voltage side power line
25 Low-voltage side power line
26 Reference voltage line
41 Scan line
42 Reset line
43 Enable line
44 Merge line
D1 Organic EL element
C1 Holding capacitor
C2 Supplementary capacitor
Q1 Driver transistor
Q2, Q3, Q4 and Q5 Transistor
SW2, SW3, SW4 and SW5 Switch

DETAILED DESCRIPTION OF PREFERRED EMBODIMENTS

Referring to the accompanying drawings, description is provided hereinafter of an image display device of active matrix type according to an exemplary embodiment of the present invention. Although the image display device described herein represents a typical organic EL display device of the active matrix type that use thin film transistors to illuminate organic EL elements, the present invention is generally applicable to any image display device of the active matrix type that uses light-emitting elements, brightness of which can be controlled by an amount of electric current flowed through them.

[Exemplary Embodiment]

FIG. 1 is a schematic diagram showing a structure of an organic EL display device according to this exemplary embodiment of the invention.

The organic EL display device in this exemplary embodiment comprises a plurality of pixel circuits 10 arranged in a matrix form, scan line drive circuit 11, data line drive circuit 12 and power line drive circuit 14. Scan line drive circuit 11 supplies scan signal Scn, reset signal Rst, enable signal Enbl and merge signal Mrg to pixel circuits 10. Data line drive circuit 12 supplies data signal $D_{ata}$ corresponding to an image signal to pixel circuits 10. Power line drive circuit 14 supplies an electric power to pixel circuits 10. Description is provided in this exemplary embodiment of an example, in which pixel circuits 10 are arranged in a form of n-row by m-column matrix.

Scan line drive circuit 11 supplies scan signal Scn independently to each of scan lines 41 connecting across pixel circuits 10 arranged in the row direction in FIG. 1, and reset signal Rst independently to each of reset lines 42 connecting across pixel circuits 10 arranged in the row direction. Scan line drive circuit 11 also supplies enable signal Enbl independently to each of enable lines 43 connecting across pixel circuits 10 arranged in the row direction, and merge signal Mrg independently to each of merge lines 44 connecting across pixel circuits 10 arranged in the row direction. On the other hand, data line drive circuit 12 supplies data signal $D_{ata}$ independently to each of data lines 20 connecting across pixel circuits 10 arranged in the column direction in FIG. 1. In this exemplary embodiment, a number of scan lines 41, reset lines 42, enable lines 43 or merge lines 44, and a number of data lines 20 are n and m respectively.

Power line drive circuit 14 supplies an electric power between high-voltage side power lines 24 and low-voltage side power lines 25 connecting throughout all pixel circuits 10. Power line drive circuit 14 also supplies a reference voltage to predetermined power lines defined as reference voltage lines 26 that connect throughout all pixel circuits 10.

Figure 2:
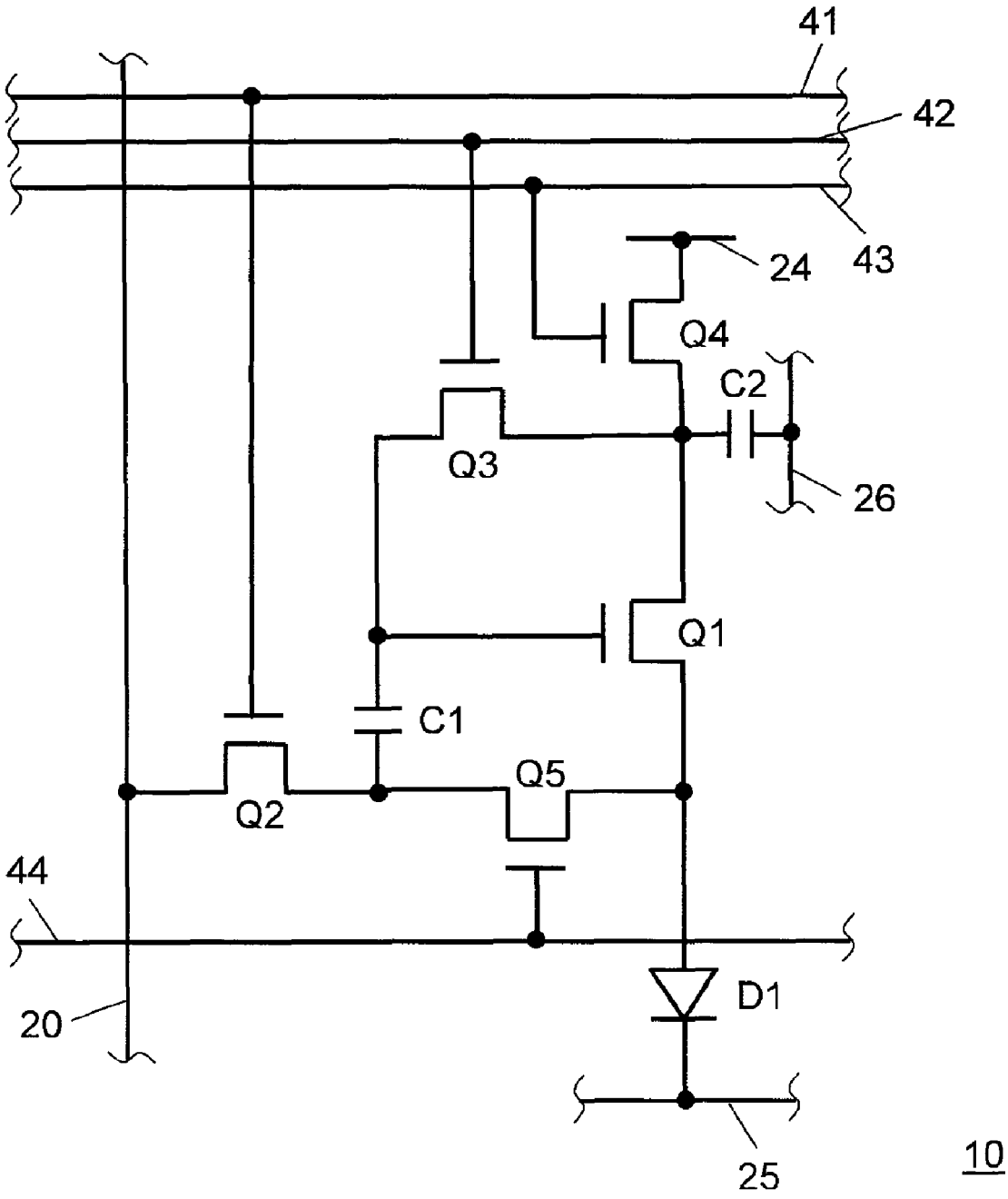
FIG. 2 is a circuit diagram of a pixel circuit according to the exemplary embodiment of the present invention.

FIG. 2 is a circuit diagram of pixel circuit 10 according to this exemplary embodiment of the invention.

Each pixel circuit 10 in this exemplary embodiment comprises organic EL element D1, or a current-driven type light-emitting element, driver transistor Q1, holding capacitor C1, transistor Q2, transistor Q3, transistor Q4 and transistor Q5. Driver transistor Q1 supplies a flow of electric current to organic EL element D1 to cause it to emit light. Holding capacitor C1 holds a voltage that determines an amount of the electric current supplied to driver transistor Q1. Transistor Q2 functions as a writing switch for writing a voltage corresponding to an image signal into holding capacitor C1. Transistor Q3 is a gate-drain connecting switch connected between the gate and the drain of driver transistor Q1. Transistor Q4 is an enable switch disposed in a current path supplying the electric current to organic EL element D1. Transistor Q5 is a separation switch for separating a connection between holding capacitor C1 and the source of driver transistor Q1 when the voltage is written into holding capacitor C1. Pixel circuit 10 also comprises a supplementary capacitor C2 for controlling changes in voltage of a terminal of holding capacitor C1 at one end opposite another terminal connected with transistor Q2. This supplementary capacitor C2 is used to superimpose data voltage $V_{data}$ on threshold voltage Vth of driver transistor Q1. All of these driver transistor Q1 and transistors Q2 to Q5 that compose pixel circuit 10 shown here are N-channel thin film transistors.

Organic EL element D1 is connected between the source of driver transistor Q1 and low-voltage side power line 25. Transistor Q4 serving as the enable switch is connected between the drain of driver transistor Q1 and high-voltage side power line 24. Supplementary capacitor C2 is connected between the drain of driver transistor Q1 and a predetermined power line defined as reference voltage line 26. In other words, the drain of transistor Q4 is connected to high-voltage side power line 24, and the source of transistor Q4 is connected to the drain of driver transistor Q1. The source of driver transistor Q1 is connected to the anode of organic EL element D1, and the cathode of organic EL element D1 is connected to low-voltage side power line 25. In this embodiment here, the voltage supplied to high-voltage side power line 24 is 20 volts, and the voltage supplied to low-voltage side power line 25 is 0 volt, for example. It is important that the reference voltage is free from fluctuations and kept stable at a given voltage that can be set to any value. It is therefore practical to use any of high-voltage side power line 24 and low-voltage side power line 25, for instance, as reference voltage line 26.

One terminal of holding capacitor C1 is connected to the gate of driver transistor Q1, and the other terminal of holding capacitor C1 is connected to the source of driver transistor Q1 through transistor Q5 and also to data line 20 through transistor Q2. Transistor Q3 is connected between the gate and the drain of driver transistor Q1. Supplementary capacitor C2 is connected between the drain of driver transistor Q1 and reference voltage line 26. The gate of transistor Q2 is connected to scan line 41, the gate of transistor Q3 is connected to reset line 42, the gate of transistor Q4 is connected to enable line 43, and the gate of transistor Q5 is connected to merge line 44.

Figure 3:
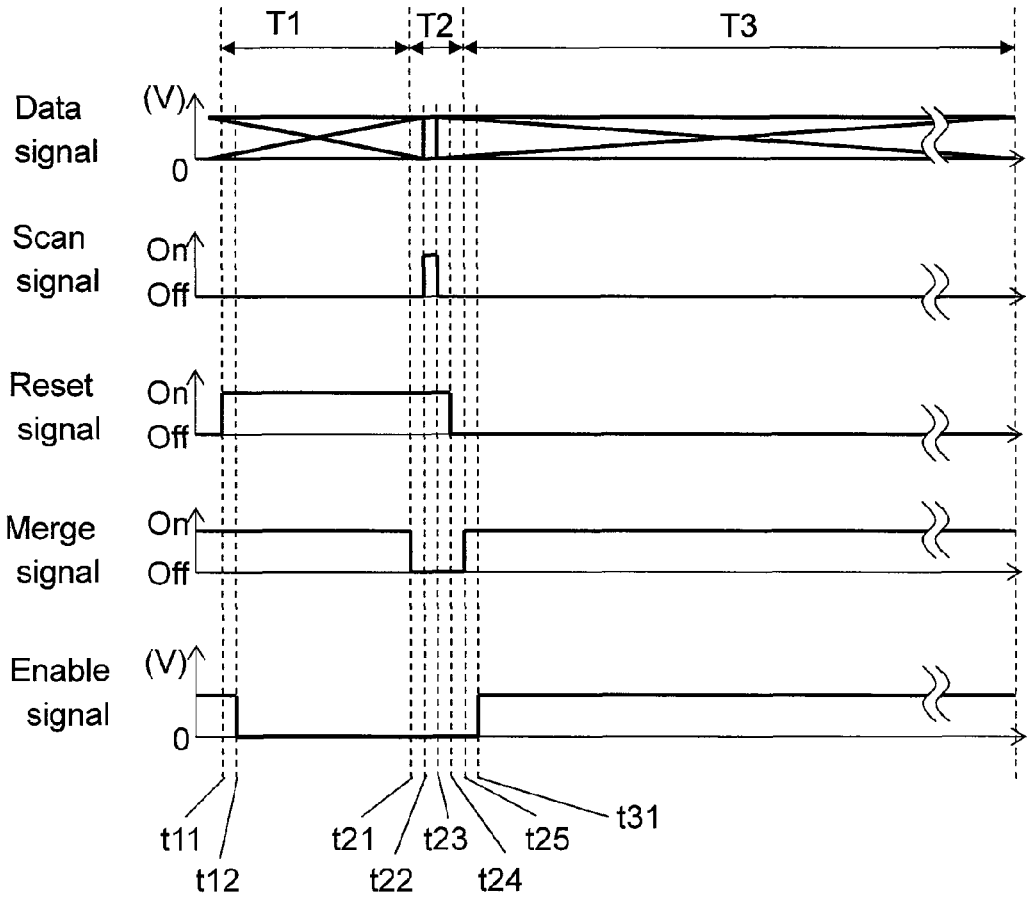
FIG. 3 is a timing chart showing operation of the pixel circuit according to the exemplary embodiment of the present invention.

Description is provided next of how pixel circuit 10 operates in this exemplary embodiment. FIG. 3 is a timing chart showing the operation of pixel circuit 10 according to this exemplary embodiment of the invention. In this exemplary embodiment, each of pixel circuits 10 performs an operation of detecting threshold voltage Vth of driver transistor Q1, an operation of writing data signal $D_{ata}$ corresponding to the image signal into holding capacitor C1, and an operation of driving organic EL element D1 to emit light according to the voltage written in holding capacitor C1 during a period of one field. A period for detecting the threshold voltage Vth, another period for writing the data signal $D_{ata}$, and still another period for driving organic EL element D1 to emit light are designated for convenience' sake as threshold detecting period T1, writing period T2 and light-emitting period T3 respectively in the following description, which provides details of the operations. Threshold detecting period T1, writing period T2 and light-emitting period T3 are defined for each individual pixel circuit 10, and phases of these three periods need not be synchronized for all pixel circuits 10. In this exemplary embodiment, pixel circuits 10 are driven in a manner to synchronize the phases of the above three periods for those arranged along the row direction, and to shift the phases of the three periods for those arranged along the column direction so as to keep individual writing periods T2 from overlapping with one another. It is desirable to use the above technique of driving pixel circuits 10 while shifting their phases in the light of improving the brightness of the image display device since it can prolong the duration of light-emitting period T3.

(Threshold Detecting Period T1)

Figure 4:
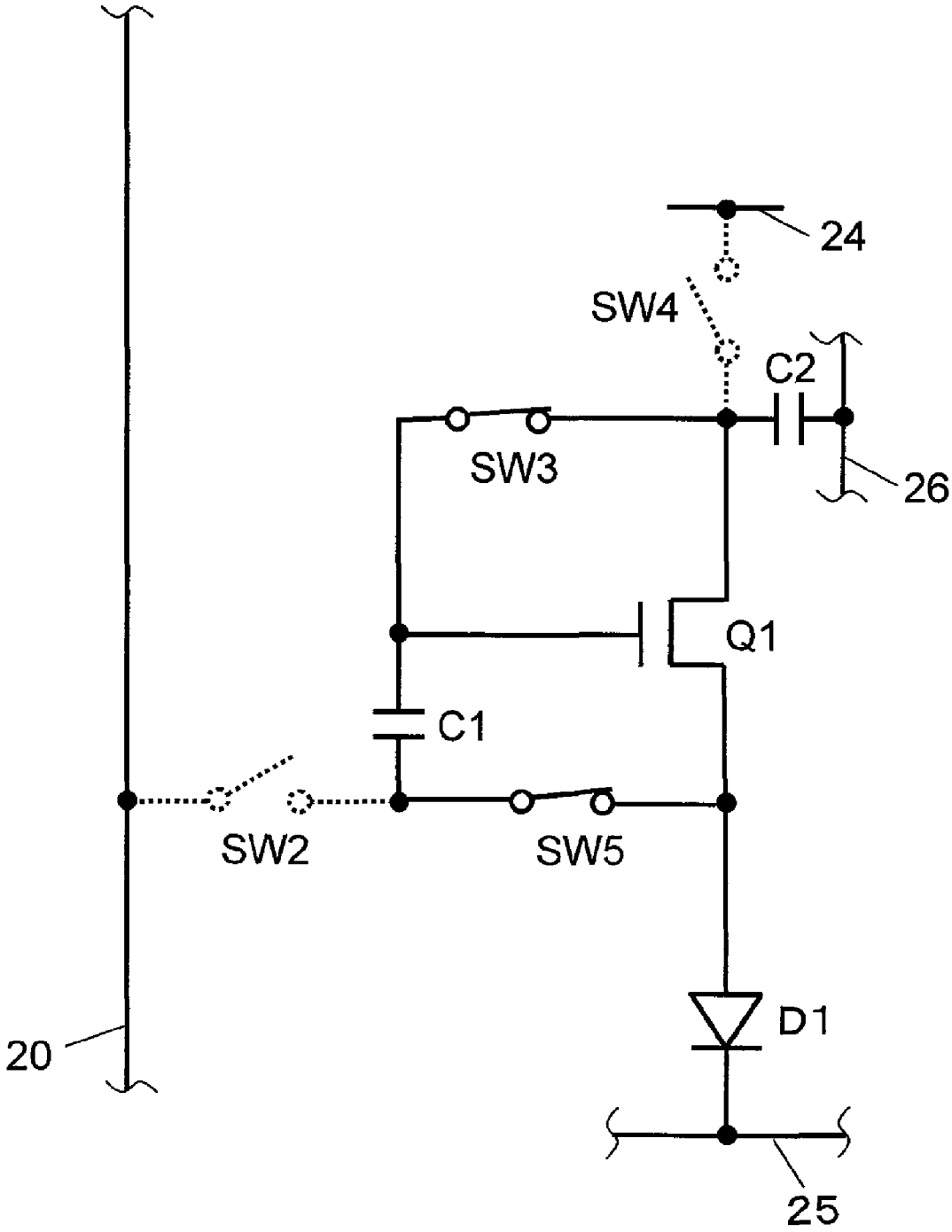
FIG. 4 is an explanatory diagram showing operation of the image display device during a threshold detecting period according to the exemplary embodiment of the present invention.

FIG. 4 is an explanatory diagram showing operation of the image display device during the threshold detecting period T1 according to this exemplary embodiment. In FIG. 4, transistors Q2 through Q5 of FIG. 2 are replaced by switches SW2 through SW5 for ease of the explanation.

At the initial time t11 of threshold detecting period T1, reset signal Rst is switched to a high level to turn switch SW3 into an on-state, which establishes continuity between the gate of driver transistor Q1 and high-voltage side power line 24. This turns driver transistor Q1 into an on-state to allow an electric current to flow therethrough, and to provide a voltage substantially greater than the threshold voltage of driver transistor Q1 across two electrodes of holding capacitor C1.

At time t12 immediately thereafter, enable signal Enbl is switched to a low level to turn switch SW4 into an off-state. This either charges or discharges supplementary capacitor C2 at the same time it lets holding capacitor C1 to discharge stored electricity, since driver transistor Q1 still remains in the on-state. As a result, voltage Vgs between the gate and the source of driver transistor Q1 begins to decrease. Driver transistor Q1 then turns into an off-state when the voltage Vgs between the gate and the source of driver transistor Q1 become equal to threshold voltage Vth. Voltage VC1 of holding capacitor C1 thus becomes a value given by $$VC1=Vth. \quad \text{(Equation 1)}$$

Accordingly, the voltage Vth is maintained across holding capacitor C1. The source voltage Vs of driver transistor Q1 is equal to off-state voltage VEoff of organic EL element D1 at this moment since there is no electric current flowing through organic EL element D1.

It is desirable to set an interval from time t11 to time t12 as short as possible since organic EL element D1 emits light irrelevant to the image signal, and this time interval is therefore set to 1 μs or shorter in this exemplary embodiment.

(Writing Period T2)

Figure 5:
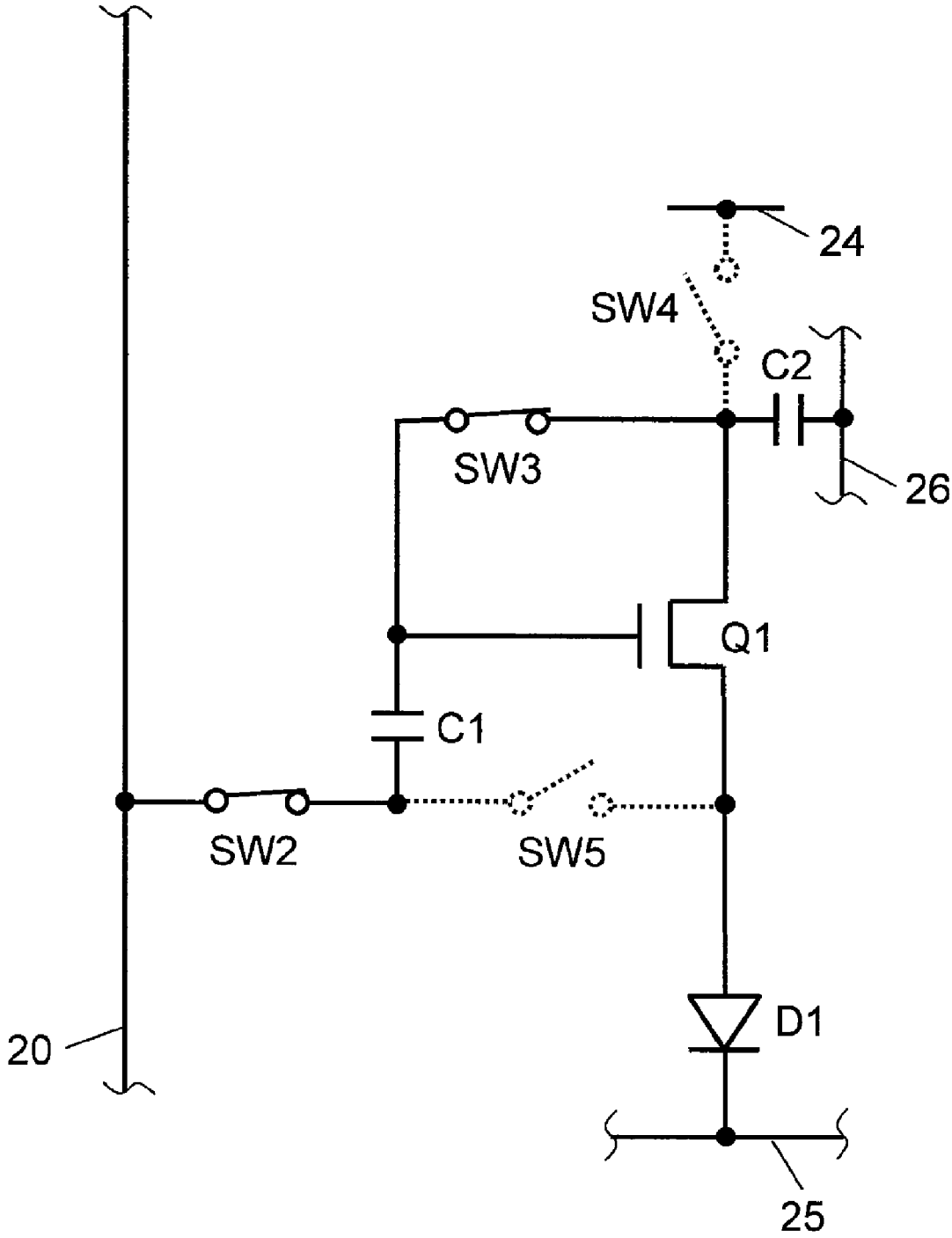
FIG. 5 is an explanatory diagram showing operation of the image display device during a writing period according to the exemplary embodiment of the present invention.

FIG. 5 is an explanatory diagram showing operation of the image display device during the writing period T2 according to this exemplary embodiment of the invention.

At time t21 in writing period T2, merge signal Mrg is switched to a low level, and switch SW5 is turned into an off-state. Scan signal Scn is then switched to a high level at time t22 to turn switch SW2 into an on-state. At this moment, a voltage ($-V_{data}$) corresponding to the image signal supplied to data line 20 is applied to one of the terminals of holding capacitor C1. An important point to be noted here is that the voltage of the one terminal of holding capacitor C1 is changed from off-state voltage VEoff to the voltage $-V_{data}$ with a net value of change in potential being $-V_{data}$−VEoff. This causes voltage VC1 of holding capacitor C1 to increase by an amount obtained by capacitively dividing a value of voltage $V_{data}$ with a capacitance of holding capacitor C1 and a capacitance of supplementary capacitor C2, to thus become a value given by $$VC1 = Vth + \frac{C2}{C1 + C2} \cdot (Vdata + VEoff). \quad \text{(Equation 2)}$$

When the writing operation in pixel circuit 10 is completed at time t23, the scan signal Scn is switched back to the low level to turn switch SW2 into the off-state, and the reset signal Rst is then switched back to the low level to turn switch SW3 into the off-state at time t24. Subsequently, merge signal Mrg is switched to a high level to at time t25 to turn switch SW5 into an on-state. This brings the voltage Vgs between the gate and the source of driver transistor Q1 to become equal to voltage VC1 of holding capacitor C1.

(Light-emitting Period T3)

Figure 6:
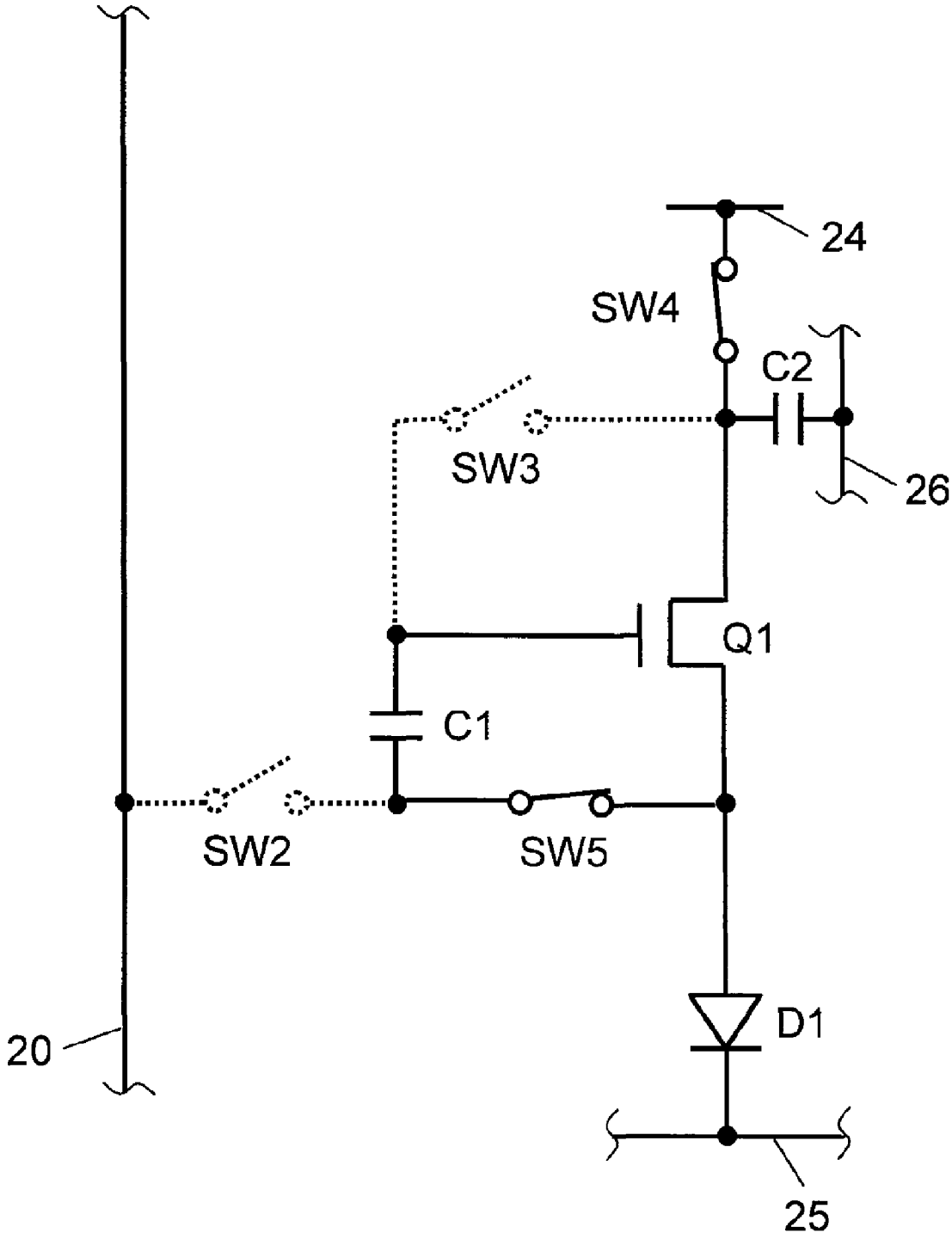
FIG. 6 is an explanatory diagram showing operation of the image display device during a light emitting period according to the exemplary embodiment of the present invention.

FIG. 6 is an explanatory diagram showing operation of the image display device during the light-emitting period T3 according to this exemplary embodiment of the invention.

At time t31, enable signal Enbl is switched to a high level to turn switch SW4 into an on-state. This allows an electric current to flow into organic EL element D1, and lets organic EL element D1 emit light of a brightness corresponding to the image signal. An electric current Ipxl that flows through organic EL element D1 during this period is given by $$\begin{aligned} Ipxl &= \frac{\beta}{2} \cdot (Vgs - Vth)^2 \\ &= \frac{\beta}{2} \cdot \left( \frac{C2}{C1 + C2} \cdot (Vdata + VEoff) \right)^2, \end{aligned} \quad \text{(Equation 3)}$$

where β is a coefficient determined based on the mobility μ, capacitance Cox of a gate insulation film, channel length L and channel width W of driver transistor Q1, and it is given by $$\beta = \mu \cdot Cox \cdot \frac{W}{L}. \quad \text{(Equation 4)}$$

As shown, the electric current Ipxl that flows through organic EL element D1 does not include a factor of threshold voltage Vth. The electric current Ipxl flowing through organic EL element D1 can thus make it emit light of the brightness corresponding to the image signal without being influenced by the threshold voltage of driver transistor Q1 even when it changes with lapse of time.

Incidentally, organic EL elements have an inherent characteristic that their off-state voltages VEoff rise as their properties deteriorate, which causes reduction in luminous efficiency, or luminous intensity per unit density of electric currents of the organic EL elements. In other words, it is not possible to keep the brightness of image display device from decreasing unless the electric currents to the deteriorated organic EL elements are increased. According to this exemplary embodiment, the electric currents supplied to the organic EL elements are made dependent on the off-state voltages VEoff of the organic EL elements in a manner so that the amount of the currents is increased as the off-state voltages VEoff rise. That is, this exemplary embodiment contributes to long-lasting brightness of the image display device.

It is also necessary to drive organic EL elements D1 in a manner not to cause unexpected changes in the voltage of holding capacitors C1 since the brightness of organic EL elements D1 is determined by the voltage of holding capacitors C1. The individual transistors are therefore controlled according to the sequence shown in FIG. 3 to positively regulate the voltage of holding capacitors C1.

As described above, the structure according to the present exemplary embodiment makes it possible to use only N-channel transistors to form pixel circuits 10, each having organic EL element D1 connected to the source of the respective driver transistor Q1 and the cathode of organic EL element D1 connected to the common low-voltage side power line. Although the pixel circuits in this exemplary embodiment are very suitable for composing large-scale display devices by using amorphous-silicon thin-film transistors, they are also suitable even when polysilicon thin film transistors are used.

In this exemplary embodiment, what has been described is the structure, in which pixel circuits 10 are driven in a manner to synchronize the phases of the three periods, namely threshold detecting period T1, writing period T2 and light-emitting period T3, for those arranged along the row direction, and to shift the phases of the three periods for those arranged along the column direction so as to keep the individual writing periods T2 from overlapping with one another. However, this shall not be taken as restrictive in the scope of this invention. For example, the period of one field is divided into the three periods including threshold detecting period T1, writing period T2 and light-emitting period T3, and all pixel circuits 10 may be driven in a synchronized manner.

It shall be noted that all figures and numbers of the voltages and other values specified in this exemplary embodiment are just example, and that it is preferable to determine them as appropriate according to characteristics of the individual organic EL elements and specifications of the applicable image display devices, and the like.

Industrial Applicability

According to the present invention, it becomes possible to use only N-channel transistors to form pixel circuits comprised of current-driven type light-emitting elements connected with the sources of driver transistors, and these pixel circuits are therefore useful for image display devices of the active matrix type that use current-driven type light-emitting elements.

The invention claimed is:

1. A method of controlling an image display device having a plurality of pixel circuits arranged in a matrix form, each of the pixel circuits including:

a current-driven type light-emitting element;

a driver transistor for supplying an electric current to the current-driven type light-emitting element;

a holding capacitor for holding a voltage that determines an amount of the electric current supplied from the driver transistor; and a writing switch for writing a voltage corresponding to an image signal into the holding capacitor during a writing period, wherein the transistor formed in each of the pixel circuits is an N-channel transistor, each of the pixel circuits further comprises an enable switch disposed in a current path supplying the electric current to the current-driven type light-emitting element and a supplementary capacitor, wherein the method comprises:

receiving power from a power line, wherein the supplementary capacitor is connected between the drain of the driver transistor and the power line, for controlling changes in voltage of a terminal of the holding capacitor at one end opposite another terminal connected with the writing switch during the writing period;

turning off the enable switch; and causing the holding capacitor to hold the voltage that determines the amount of the electric current supplied from the driver transistor by turning on the writing switch while the writing switch is on and the enable switch is off.

2. The method according to claim 1, further comprising:

electrically connecting the supplementary capacitor with a terminal of the holding capacitor at one end opposite another terminal connected with the writing switch when the holding capacitor holds the voltage that determines the amount of the electric current supplied from the driver transistor by turning on the writing switch.

3. A method of controlling an image display device having a plurality of pixel circuits arranged in a matrix form, each of the pixel circuits including:

a current-driven type light-emitting element;

a driver transistor for supplying an electric current to the current-driven type light-emitting element;

a holding capacitor for holding a voltage that determines an amount of the electric current supplied from the driver transistor; and a writing switch for writing a voltage corresponding to an image signal into the holding capacitor during a writing period, wherein the transistor formed in each of the pixel circuits is an N-channel transistor, each of the pixel circuits further comprises an enable switch disposed in a current path supplying the electric current to the current-driven type light-emitting element and a supplementary capacitor, wherein the method comprises:

turning off the enable switch;

causing the holding capacitor to hold the voltage that determines the amount of the electric current supplied from the driver transistor by turning on the writing switch while the writing switch is on and the enable switch is off; and connecting one terminal of the supplementary capacitor with a terminal of the holding capacitor at one end opposite another terminal connected with the writing switch and connecting another terminal of the supplementary capacitor with a power line supplying a predetermined voltage, during the writing period.

* * * * *